United States Patent [19]

Binkofski et al.

[11] Patent Number: 5,074,932

[45] Date of Patent: Dec. 24, 1991

[54] FINE-CRYSTALLINE IRON-BASED ALLOY CORE FOR AN INTERFACE TRANSFORMER

[75] Inventors: Johannes Binkofski, Rodenbach; Diemtar Graetzer, Kahl; Giselher Herzer, Hanau; Hans-Reiner Hilzinger, Langenselbold; Joerg Petzold, Bruchkoebel, all of Fed. Rep. of Germany

[73] Assignee: Vacuumschmelze GmbH, Fed. Rep. of Germany

[21] Appl. No.: 497,927

[22] Filed: Mar. 23, 1990

[30] Foreign Application Priority Data

Apr. 8, 1989 [DE] Fed. Rep. of Germany ..... 3911618

[51] Int. Cl.[5] ..... H01F 1/047; H01F 27/24

[52] U.S. Cl. ..... 148/304; 148/307

[58] Field of Search ..... 148/304, 306, 307

[56] References Cited

U.S. PATENT DOCUMENTS 4,587,507 5/1986 Takayama et al. ..... 148/304
4,881,989 11/1989 Yoshizawa et al. ..... 148/307

FOREIGN PATENT DOCUMENTS 0271657 10/1987 European Pat. Off. .
0299498 7/1988 European Pat. Off. .
179704 8/1987 Japan ..... 148/304

OTHER PUBLICATIONS

International Standard CCITT I.430.
German Post Office Standard FTZ 1 TR 230.
Hugh Hemphill, "Choosing Pulse Transformers for ISDN Applications".
Groben, Formeln, Begriffe, "Technische Tabellen", p. 49, (1949).

*Primary Examiner*—Upendra Roy
*Assistant Examiner*—George Wyszomierski
*Attorney, Agent, or Firm*—Hill, Van Santen, Steadman & Simpson

[57] ABSTRACT

In an ISDN digital communications system, the transmission between the network termination and the terminal equipment ensues via what is referred to as the $S_o$ interface, on the basis of interface transformers. Since the power supply of the terminal equipment likewise partly ensues via these transformers, a current asymmetry in the lines results in a pre-magnetization of the transformers. Thus, the ISDN demands made of the transformers must also be satisfied given a DC pre-magnetization. Compact transformers having a simple winding format that satisfy the ISDN demands are set forth, the transformers utilizing a magnetic core having a fine-crystalline iron-based alloy with an iron part of more than 60 atomic %, the structure thereof being more than 50% fine-crystalline grains having a grain size of less than 100 nm and having a remanence ratio of less than 0.2 and a permeability in the range from 20,000 to 50,000, and an inductance of less than 100 pF.

5 Claims, 3 Drawing Sheets

FINE-CRYSTALLINE IRON-BASED ALLOY CORE FOR AN INTERFACE TRANSFORMER

BACKGROUND OF THE INVENTION

1. Field of the Invention

The invention is directed to a magnetic core for an interface transformer. More specifically, the invention is directed to an interface transformer having a core material which enables the transformer to be utilized in an $S_o$ interface of an ISDN network, such a transformer being employed at the interface between the network termination and the individual terminal equipment.

2. Description of the Art

An integrated services digital network (ISDN) is a recently developed worldwide digital communications system. In such a network, a $Uk_0$ line interface provides the required connection between a digital local switching center and a network termination. The distance between the digital, local switching center and a network termination in such a system can amount to a maximum of 8 km.

Up to eight terminal units can be connected to a single network termination. The terminal units, for example, can be telephones, picture screen telephones, picture screen text, facsimile, textfax, work station, etc. The terminal units can be located at a distance of up to 150 m from the respective network termination.

The interface between the network termination and the terminal unit is referred to as an $S_o$ user interface. The various electrical characteristic requirements of such an $S_o$ interface are defined in the international standard CCITT I.430 or, respectively, in the Standard FTZ 1 TR 230 of the German Federal Mails. These standards define, inter alia, the impedance of the interface as a function of the frequency as well as the pulse mask for the transmitted, digital pulses.

A company publication, PUBL 1101 E by H. Hemphill, Using Pulse Transformers for ISDN-Applications, Schaffner Elektronik AG, Luterbach, Switzerland, is concerned with the magnetic and electrical property requirements of $S_o$ interface transformers that are based on these standards. For example, FIGS. 2 and 3 in this publication set forth the impedance and pulse transmission requirements according to the postal standards.

Among the specific items discussed in this publication are RM6 cores which are used as magnetic cores for $S_o$ interface transformers. Ferrite is cited as the core material. Use of such ferrite cores limits the values for the permeability $\mu$ and the saturation induction Bs. Typical values for these variables are $\mu=10{,}000$, Bs=0.45 T (SIFERIT T38 of Siemens).

Whether a digital pulse can be transmitted within the prescribed pulse mask is essentially dependent on the inductance and capacitance characteristics of the transformer. The inductance L of the transformer dictates the pulse droop of the transmitted pulse. The pulse droop is defined as the undesired decrease of the voltage which the transmitted pulse experiences during the course of the pulse duration. In order to satisfy the ISDN demands with respect to the pulse droop values, the inductance of the transformer must be greater than 20 mH at 10 kHz.

The coupling capacitance values of a transformer also define the signal shape of the transmitted pulse. This coupling capacitance is the capacitance between two different windings of the transformer and is dependent, inter alia, on the number of applied turns as well as on the winding arrangement. In particular, this coupling capacitance defines the shape of the pulse as it makes the transition from its high status to its low status. To maintain the integrity of the pulse shape, the transformer is designed so that the coupling capacitance is minimized.

The inductance of the transformer is directly proportional to the permeability of the core material. In order to satisfy the ISDN demands with respect to the inductance, particularly given a DC pre-magnetization of the transformer, a comparatively large magnetic core cross-section is required. A larger magnetic core cross-section, however, means enlarging the magnetic core and, thus, enlarging the structural volume of the transformer. Optimally small components are desirable. Alternatively, the ISDN demands with respect to the inductance may be accomplished with a larger number of turns of the transformer winding. A higher number of turns, however, results in an increase in the coupling capacitance and, thus, a deterioration of the transmission behavior. The increased capacitance due to the added turns can be partially overcome by utilizing complicated winding arrangements having insulating layers lying between the windings. This complicates the manufacture of the winding and, thus, renders such transformers more costly.

SUMMARY OF THE INVENTION

An interface transformer, capable of meeting ISDN requirements, is disclosed, which utilizes a magnetic core. The magnetic core enables a transformer construction having an optimally small structural volume and a simple winding format employing a minimal number of turns. The magnetic core is comprised of fine-crystalline, iron-based alloys having extremely low magnetostriction values. A transformer constructed with the disclosed magnetic core is capable of meeting ISDN demands despite the existence of DC pre-magnetization since the permeability drops due to voltages present in such materials are extremely low.

European Published Application 271 657 discloses fine-crystalline Fe-based alloys and methods for their manufacture. Specifically, this reference discloses alloys that, in addition to iron, contains 0.1 through 3 atomic % copper, 0.1 through 30 atomic % of metals such as Nb, W, Ta, Zr, Hf, Ti or Mo, up to 30 atomic % silicon and up to 25 atomic % boron, whereby the overall content of silicon and boron lies in the range between 5 and 30 atomic %. Similarly, European Published Application 299 498 also discloses magnetic cores composed of fine-crystalline iron-based alloys that retain their mechanical properties at elevated application temperatures. Due to their excellent high frequency magnetic properties, such alloys are used in radio-frequency transformers, inductors and magnetic heads.

In fine-crystalline iron-based alloys having $\mu>50{,}000$, the permeability decreases greatly given a relatively slight degree of pre-magnetization, so that the required inductance can only be achieved with a comparatively large magnetic core cross-section or, alternatively, a high number of turns. When the permeability $\mu<20{,}000$, then the required inductance is likewise only achieved on the basis of the cited measures.

The transformers of the present invention employ a core comprising a fine-crystalline, iron-based alloy having an initial permeability of more than 20,000 and less than 50,000. The iron content of the alloys amounts to more than 60 atomic %. Additionally, the alloys have a structure with more than 50% fine-crystalline grains having a grain size of less than 100 nm, and preferably less than 25 nm. The materials have a flat hysteresis loop with a remanence ratio of less than 0.2.

Transformers employing such a core, in contrast to transformers employing other core types, experience an extremely limited drop in the permeability given the presence of a DC field pre-magnetization. Consequently, such alloys are well suited for use as magnetic core materials in interface transformers that must have an inductance L of more than 20 mH measured at 10 kHz, and which must have an optimally low coupling capacitance.

Thus, compact interface transformers having small dimensions are manufactured with the magnetic cores of the invention. Even with a simple winding format, the interface transformers satisfy the requirements reflected in the ISDN standards. In particular, the transformers achieve the required inductance values despite the existence of a DC pre-magnetization, the pre-magnetization resulting from an asymmetrical power distribution in the ISDN.

BRIEF DESCRIPTION OF THE DRAWINGS

Other objects, features, and advantages of the invention, will best be understood from the following detailed description, taken in conjunction with the accompanying drawings.

DESCRIPTION OF THE PREFERRED EMBODIMENT

Figure 1:
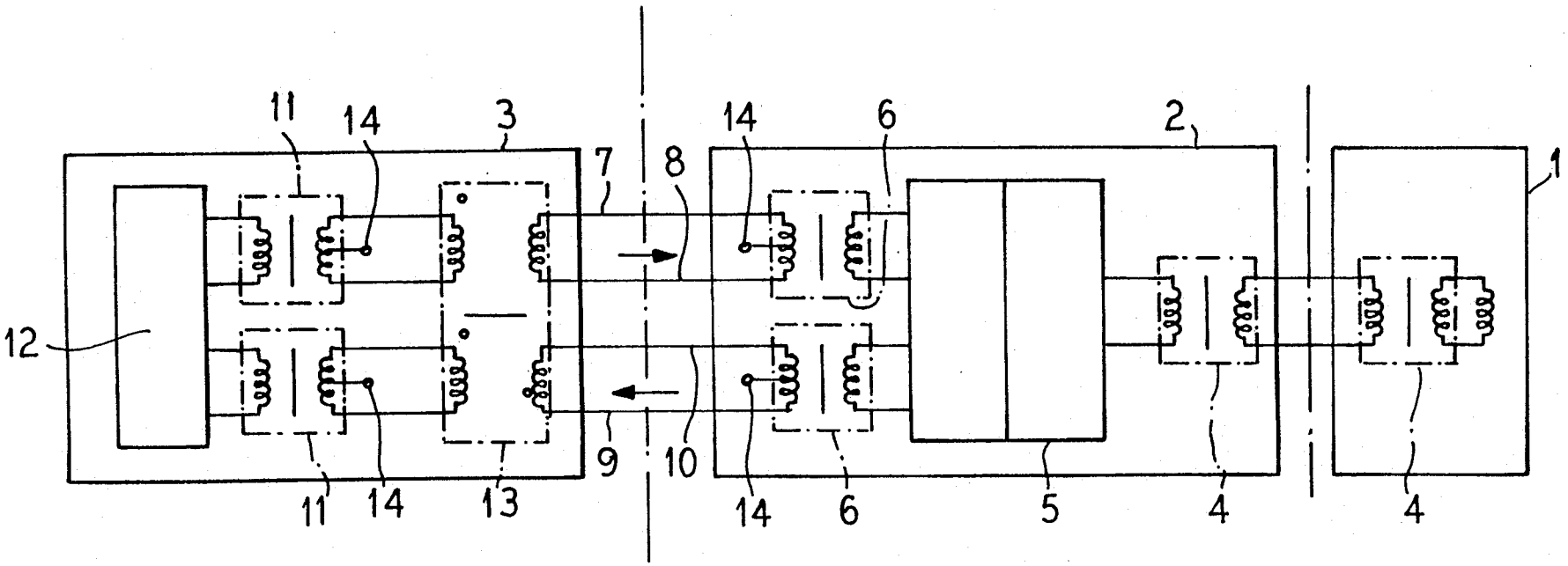
FIG. 1 is a schematic diagram showing the interfaces and inductive components of an ISDN employing interface transformers constructed in accordance with the present invention.

FIG. 1 shows the interfaces and inductive components of an ISDN network. In particular, the figure shows the $UK_o$ line interface between the digital switching center 1 and the network termination 2, as well as the $S_o$ subscriber interface between the network termination 2 and the terminal equipment 3.

As can be seen in the figure, a plurality of $Uk_o$ interface transformers 4 are utilized for the transmission of information between the digital switching center 1 and the network termination 2. The processing of the digital signals in the network termination 2 is carried out by electronic components 5. The network termination also contains the NT interface transformers 6 of the $S_o$ interface. The communication of the digital signals between the network termination 2 and the terminal 3 ensues via the transmission lines 7,8 and the reception lines 9, 10. Within the terminal equipment 3, the signals are converted via the TE interface transformer 11 and are further processed with electronic components 12. The terminal equipment 3 also contains current-compensated noise-suppression inductors 13. The magnetic cores of the invention are employed in the NT interface transformer 6 and in the TE interface transformer 11 of the $S_o$ interface.

In many instances, the power to the terminal equipment is supplied from the digital switching center via the $S_o$ subscriber interface. This is the case when the terminal equipment is, for example, a telephone set. Although the remote feed of the terminal equipment is not shown in FIG. 1, it ensues via the center tap 14 of the NT interface transformer 6.

In the ideal case, the feed current is divided equally onto the transmission lines 7, 8 and, respectively, the reception lines 9, 10. In practice, however, different current paths have different resistances and, consequently, an unequal current distribution results. This unequal distribution is present, for example, when the transformers have different winding resistances as well as when there are different plug contact resistances at the transmission line connections or, respectively, of the cord of the terminal equipment.

An asymmetry of the current in the transmission lines 7, 8 and, respectively, in the reception lines 9, 10 leads to a pre-magnetization in the NT interface transformer 6 or, respectively, in the TE interface transformers 11 of the $S_o$ interface. Intensive investigations and calculations regarding this effect has shown that a pre-magnetization current of about 3 mA occurs in the TE interface transformer 11. The anticipated maximum pre-magnetization current in the NT interface transformer 6, by contrast, is significantly higher since up to eight terminal equipment can be connected in parallel to a single network termination. Consequently, a pre-magnetization current of 12mA can be anticipated at the NT interface transformer 6.

In order to guarantee the transmission of a digital pulse within the prescribed pulse mask criterion required by the ISDN standards, the transformer must have an inductance of more than 20 mH at the recited pre-magnetization currents at a frequency of 10 KHz. Further, the coupling capacitance should be low, the upper limit of the coupling capacitance being approximately 100 pf. Interface transformers embodying various magnetic cores constructed in accordance with the invention are set forth below. Such transformer meet the aforementioned ISDN criterion.

The magnetic core materials cited in the following examples were manufactured in the form of thin bands according to the method disclosed by European published application 271 657. Toroidal tape cores were then wound from the bands. These toroidal tape cores were subsequently subjected to a thermal treatment in a cross-field, i.e. in a magnetic field parallel to the rotational symmetry axis of the toroidal tape cores. Flat hysteresis loops, having a remanence ratio Br/Bs of less than 0.2, were thereby achieved (Br indicates the remanent induction and Bs indicates the saturation induction).

For comparative purposes, further toroidal tape cores were made. Some of these further toroidal tape cores were heat-treated in a longitudinal field, while others were manufactured without being subjected to a magnetic field. Such processing yielded magnetic core materials having initial permeability values and remanence ratios outside of the claimed range.

Finished transformers were manufactured with toroidal tape cores having the dimensions $14\times7\times6$ mm. The dependency of the inductance L on pre-magnetization current at 10kHz was respectively measured.

EXEMPLARY EMBODIMENTS

Example a)

Figure 2:
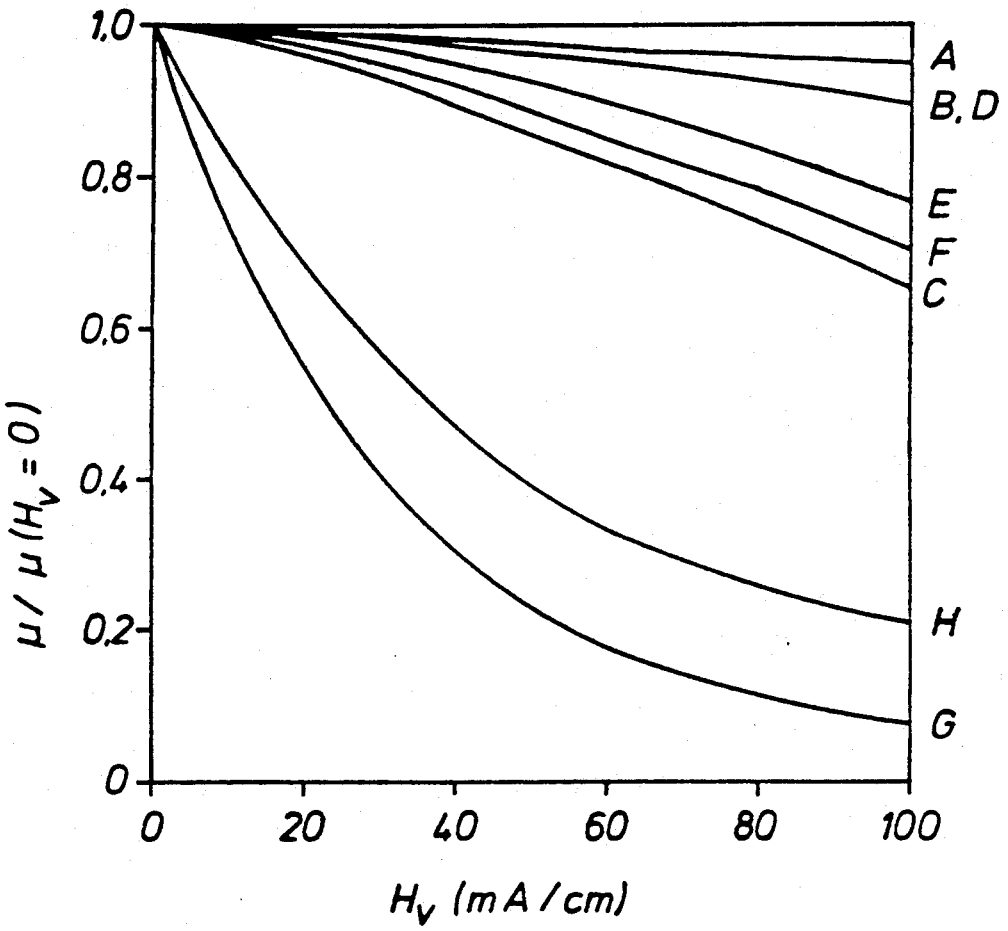
FIG. 2 is a graph showing the relationship between the permeability of various magnetic cores constructed in accordance with the invention and the pre-magnetization at 20 kHz.

A magnetic core that contained 1 atomic % copper, 3 atomic % niobium, 13.5 atomic % silicon and 9 atomic % boron in addition to 73.5 atomic % iron was subjected to thermal treatments for one hour at 540° C. and three hours at 280° C., in a cross-field. The resulting magnetic core had an initial permeability of 23,000. In FIG. 2, the dependency of the standardized permeability (permeability with pre-magnetization divided by permeability without pre-magnetization) versus the pre-magnetization is shown. As can be seen at curve A, the permeability of the core has a low dependency on the pre-magnetization. Thus, the inductance likewise has a low dependency on the pre-magnetization.

Figure 3:
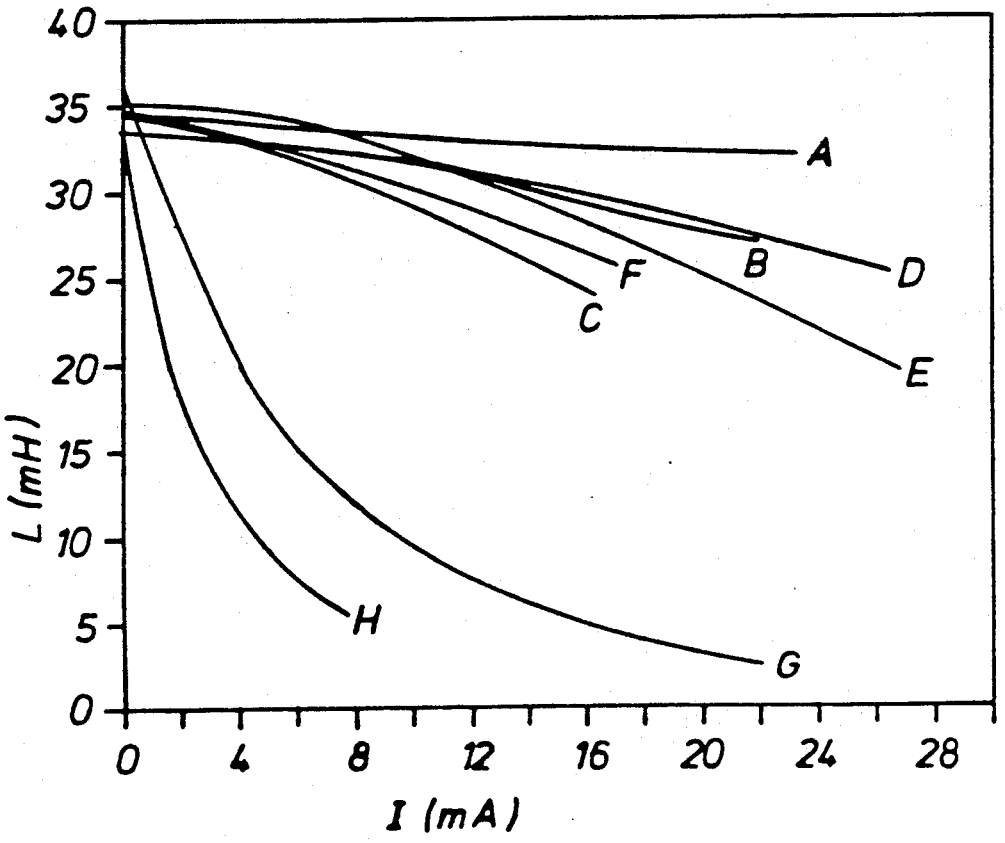
FIG. 3 is a graph showing the relationship between the induction of various interface transformers utilizing magnetic cores constructed in accordance with the present invention and the pre-magnetization current at 10 kHz.

The dependency of the inductance on pre-magnetization current for a transformer having an overall number of turns of 2N=48 is shown by curve A of FIG. 3. As can be seen, this magnetic core is well suited for use in an interface transformer that is subject to a DC bias. The inductance of the transformer constructed with this core amounted to 33 mH, despite the presence of a 12 mA. DC bias current.

The required inductance of at least 20 mH for an interface transformer is obtainable with this core given a pre-magnetization current of 12 mA and a total number of turns of 2N=36. Since the number of turns is minimized, a low value for the coupling capacitance results, this capacitance being on the order of 35 pF where the winding format is simple.

Example b)

Magnetic materials having the same composition as in Example a) were subjected to a thermal treatment in a cross-field for 1 hour at 540° C. and were subsequently cooled at a rate of 10 K/min in this field. The toroidal tape cores manufactured therefrom had an initial permeability of 31,000. The dependency of the permeability on the pre-magnetization is shown by curve B of FIG. 2. As can be seen from this curve, the permeability values of these magnetic cores also exhibited an extremely low dependency on the pre-magnetization. Finished transformers having a total number of turns of 2N=40 had values of inductance noticeably above the minimum value demanded (FIG. 3, curve B).

Example c)

Magnetic core materials having the same composition as in Examples a) and b) were subjected to a thermal treatment in a cross-field for 1 hour at 540° C. and were subsequently air cooled. An even higher value of the initial permeability of approximately 35,000 was achieved by this thermal treatment.

As may be seen from FIG. 2, curve C, the permeability is slightly more dependent on the pre-magnetization and decreases at a somewhat more rapid rate with increasing pre-magnetization. However, the demands made of an interface transformer could also be satisfied with this core, as may be seen from FIG. 3, curve C, four of the tested transformers meeting the demand when constructed with a total number of turns of 2N=38.

Example d)

Magnetic core materials that contained 1 atomic % copper, 3 atomic % niobium, 16.5 atomic % silicon and 6 atomic % boron in addition to 73.5 atomic % iron were subjected to the same thermal treatment as in Example a). These cores had an initial permeability of 28,000.

As may be seen from FIG. 2, curve D, the permeability of these magnetic cores were only slightly dependent on the pre-magnetization. The inductance requirements for an interface transformer were satisfied with a transformer having a total number of turns of 2N=42 (FIG. 3, curve D).

Example e)

Magnetic core materials having the same composition as in Example d) were subjected to a thermal treatment as in Example b). The relationship between the permeability and the pre-magnetization is shown in FIG. 2, curve E, and the dependency of the inductance on the pre-magnetization current for a transformer having 2N=38 is shown in FIG. 3, curve E.

Example f)

Cores having the same composition as in Examples d) and e) were subjected to a thermal treatment as in Example c). A permeability of 38,000 was found. The decrease in permeability dependent on the pre-magnetization was somewhat greater than in Examples d) and e) and is shown in FIG. 2, curve F. As may be seen from FIG. 3, curve F, however, an inductance of more than 30 mH was obtained at a pre-magnetization current of 12 mA with a transformer having a total number of turns of 2N=36.

As may be seen from the above examples, all of the magnetic cores of the invention are extremely well-suited for employment in interface transformers.

For comparison purposes, magnetic core materials having the same composition as in Examples a) through c) were subjected to thermal treatment without a corresponding magnetic field for one hour at 540° C. and were subsequently air cooled (Example g). Further magnetic core materials were also subjected to thermal treatment in a longitudinal field for 1 h at 540° C. and were subsequently cooled at a rate of 1° K./min (Example h).

The core that was thermally treated absent the presence of the magnetic field, had an initial permeability of 58,000 and the core treated in the longitudinal field had an initial permeability of 6,000. As may be seen from FIG. 2 (curves G and H), these comparison cores had a very pronounced decrease of their respective permeabilities given a DC pre-magnetization. Without pre-magnetization current, finished transformers with the material (Example g) treated without magnetic field and having a total number of turns of 2N=28 achieved an inductance of about 35 mH comparable to the transformers of the invention. As may be seen from FIG. 3, curve G, however, they only achieved an inductance of 7 mH given a pre-magnetization current of 12 mA.

Transformers that contained the toroidal tape cores having the material from Example h likewise exhibited a great decrease in inductance with increasing pre-magnetization current, as may be seen from FIG. 3, curve H, for a transformer having a total number of turns of 2N=42.

With the magnetic cores of the invention, by contrast, extremely compact transformers can be manufactured that satisfy the ISDN demands. They can also be particularly utilized for the NT interface transformer 6 wherein, a pre-magnetization current up to about 12 mA is anticipated.

Although modifications and changes may be suggested by those skilled in the art, it is the intention of the inventor to embody within the patent warranted hereon all changes and modifications as reasonably and properly come within the scope of his contribution to the art.

We claim:

1. An interface transformer for an $S_o$ interface of an ISDN network comprising:

a magnetic core including a low-magnetostiction Fe-based alloy having more than 60 atomic % iron, the Fe-based alloy having a structure including more than 50% fine-crystalline grains, the grains having a grain size of less than 100 nm, a remanence ratio Br/Bs of less than 0.2, and an initial relative permeability ranging from 20,000 to 50,000; an inductance of more than 20 mH; and a coupling capacitance of no more than 100 pF.

2. The interface transformer of claim 1, wherein said inductance is more than 20 mH in the presence of a dc pre-magnetization.

3. The interface transformer of claim 1, wherein the grain size is less than 25 nm.

4. The interface transformer of claim 1, wherein the Fe-based alloy further comprises 0.1 to 3.0 atomic % copper, no more than 30 atomic % silicon, no more than 25 atomic % boron, and 0.1 to 30.0 atomic % other metals, the other metals being selected from the group consisting of niobium, tungsten tantalum, zirconium, hafnium, titanium and molybdenum.

5. The interface transformer of claim 4, wherein the silicon and the boron comprise approximately 5 to 30 atomic % of the Fe-based alloy.

* * * * *